United States Patent [19]

Satsuki et al.

[11] Patent Number: 4,549,984

[45] Date of Patent: Oct. 29, 1985

[54] LIQUID DETERGENT COMPOSITION

[75] Inventors: Teruhisa Satsuki, Funabashi; Seiiti Ota, Chiba, both of Japan

[73] Assignee: Lion Corporation, Tokyo, Japan

[21] Appl. No.: 597,894

[22] Filed: Apr. 9, 1984

[30] Foreign Application Priority Data

Jun. 30, 1983 [JP] Japan ..... 58-116989

[51] Int. Cl.[4] ..... C11D 1/12; C11D 1/37

[52] U.S. Cl. ..... 252/532; 252/533; 252/538; 252/551; 252/552; 252/557; 252/DIG. 14; 252/DIG. 10; 252/DIG. 13; 252/173

[58] Field of Search ..... 252/DIG. 14, 532, 533, 252/538, 551, 552, 557

[56] References Cited

U.S. PATENT DOCUMENTS

| | | | |
|---|---|---|---|
| 3,915,881 | 10/1975 | Davies et al. | 252/109 |
| 3,998,750 | 12/1976 | Payn et al. | 252/108 |

FOREIGN PATENT DOCUMENTS

| | | |
|---|---|---|
| 47-6276 | 4/1972 | Japan . |
| 47-12582 | 6/1972 | Japan . |
| 49-116106 | 11/1974 | Japan . |
| 50-38708 | 4/1975 | Japan . |
| 51-47007 | 4/1976 | Japan . |
| 52-117908 | 10/1977 | Japan . |
| 54-132609 | 10/1979 | Japan . |
| 1338935 | 11/1973 | United Kingdom . |
| 1368736 | 10/1974 | United Kingdom . |

*Primary Examiner*—Paul Lieberman
*Assistant Examiner*—Hoa Van Le
*Attorney, Agent, or Firm*—Armstrong, Nikaido, Marmelstein & Kubovcik

[57] ABSTRACT

A liquid detergent composition comprising:

(a) disalt of an alpha-sulfonated fatty acid having the general formula (I):

$$R_1-\underset{\underset{SO_3M'}{|}}{CH}-COOM \qquad (I)$$

wherein $R_1$ is an alkyl or alkenyl group having 8 to 16 carbon atoms and M and M′ are independently a cation capable of forming a water-soluble salt selected from the group consisting of substituted and unsubstituted ammonium groups; and (b) an poly(oxyethylene) alkyl ether sulfate having the general formula (II):

$$R_2-O-CH_2CH_2O)_nSO_3M'' \qquad (II)$$

wherein $R_2$ is an alkyl group having 9 to 15 carbon atoms, n is a number of 0.5 to 7, and M″ is a cation selected from the group consisting of alkali metals, alkaline earth metals, substituted and unsubstituted ammonium groups, and the weight ratio of the component (a) to the component (b) being within the range of from 1/5 to 1/2.

This liquid detergent composition does not cause the formation of film of the salt of an poly(oxyethylene) alkyl ether sulfuric acid and has good detergency characteristics.

5 Claims, No Drawings

LIQUID DETERGENT COMPOSITION

BACKGROUND OF THE INVENTION

1. Field of the Invention

The present invention relates to a liquid detergent composition. More specifically, it relates to a liquid detergent composition containing a specified salt of an alpha-sulfonated fatty acid and an poly(oxyethylene) alkyl ether sulfuric acid in a specified weight ratio to thereby prevent the formation of film of the poly(oxyethylene) alkyl ether sulfate.

2. Description of the Prior Art

Salts of alpha-sulfonated fatty acid are used as the dialkali salt form for solid detergents, as disclosed in, for example, Japanese Examined Patent Publication (Kokoku) No. 38-3265 and Japanese Unexamined Patent Publication (Kokai) No. 49-116106. It is well-known in the art that the disodium salts of alpha-sulfonated fatty acids themselves do not exhibit good detergent characteristics due to the fact that they are only slightly soluble in water. For this reason, the disodium salts of alpha-sulfonated fatty acids are generally used together with other surfactants, as disclosed in, for example, Japanese Unexamined Patent Publication (Kokai) Nos. 47-6276 and 57-12582. However, the characteristics of the disodium salts of alpha-sulfonated fatty acids are not fully exhibited or utilized in the conventional manner.

Furthermore, aqueous solutions of the poly(oxyethylene) alkyl ether sulfates are likely to form film upon exposure to air. It is proposed in, for example, Japanese Unexamined Patent Publication (Kokai) No. 53-92809 that the above-mentioned film formation is prevented by using, as an additive, polyethylene glycol or inorganic salts.

SUMMARY OF THE INVENTION

Accordingly, the object of the present invention is to prevent the formation of the film caused by air exposure of an aqueous solution of the poly(oxyethylene) alkyl ether sulfate and to provide a liquid detergent composition containing poly(oxyethylene) alkyl ether sulfate, which has good detergent characteristics and which does not cause the formation of the film.

Other objects and advantages of the present invention will be apparent from the following description.

In accordance with the present invention, there is provided a liquid detergent composition comprising:

(a) disalt of an alpha-sulfonated fatty acid having the general formula:

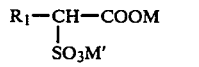

$$R_1-\underset{\underset{SO_3M'}{|}}{CH}-COOM \quad (I)$$

wherein $R_1$ is an alkyl or alkenyl group having 8 to 16 carbon atoms and M and M' are independently a cation capable of forming a water-soluble salt selected from the group consisting of substituted and unsubstituted ammonium groups; and (b) an poly(oxyethylene) alkyl ether sulfate having the general formula (II):

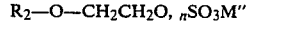

$$R_2-O-CH_2CH_2O,_nSO_3M'' \quad (II)$$

wherein $R_2$ is an alkyl group having 9 to 15 carbon atoms, n is a number of 0.5 to 7, and M'' is a cation selected from the group consisting of alkali metals, alkaline earth metals, substituted and unsubstituted ammonium groups, and the weight ratio of the component (a) to the component (b) being within the range of from 1/5 to ½.

DESCRIPTION OF THE PREFERRED EMBODIMENTS

The inventors have found by observation with a polarization microscope that the above-mentioned film formed from an poly(oxyethylene) alkyl ether sulfate is the liquid crystal thereof and that the formation of film in an aqueous solution of an poly(oxyethylene) alkyl ether sulfate is effectively prevented by salts of alpha-sulfonated fatty acid having, as hydrophilic groups, both a $COO^-$ group and a $SO_3^-$ group and having counter ions such as ammonia, monoethanol amine, and triethanol amine. The use of disalts of alpha-sulfonated fatty acid also contributes to the improvement in the detergent characteristics.

The salts of alpha-sulfonated fatty acid usable as a component (a) in the present liquid detergent composition are those having the above-mentioned general formula (I). The group $R_1$ in the general formula (I) must be an alkyl or alkenyl group having 8 to 16 carbon atoms. The use of the alpha-sulfonated fatty acid salts having $R_1$ of less than 8 carbon atoms cannot prevent the formation of the film. Contrary to this, the use of the alpha-sulfonated fatty acid salts having $R_1$ of more than 16 carbon atoms undesirably causes a milky turbidity in the liquid detergent composition over a period of time and also results in a weak film prevention effect. The counter ions M and M' are substituted and unsubstituted ammonium groups and, preferably, substituted ammonium groups such as monoethanolamine, diethanolamine, and triethanolamine.

Examples of the alpha-sulfonated fatty acid salts are diammonium, 2 triethanolamine, and 2 diethanolamine salts of alpha-sulfonated lauric acid, alpha-sulfonated myristic acid, alpha-sulfonated palmitic acid, alpha-sulfonated hardened palm fatty acid, alpha-sulfonated hardened tallow fatty acid, and alpha-sulfonated coconut fatty acid.

These alpha-sulfonated fatty acid salts can be obtained ether by sulfonating fatty acids having 10 to 18 total carbon atoms with sulfur trioxide in a conventional continuous thin-film type sulfonation apparatus or vessel type sulfonation apparatus, followed by neutralization, or by sulfonating fatty acid esters, followed by heating in the presence of a strong alkali. These disalts alpha-sulfonated fatty acid are preferably included at a concentration of 2% to 25% by weight, more preferably 4% to 15% by weight in an aqueous medium.

The poly(oxyethylene) alkyl ether sulfate usable as a component (b) in the present liquid detergent composition are those having the above-mentioned general formula (II). The group $R_2$ in the general formula (II) must be an alkyl group having 9 to 15 carbon atoms and the average addition mol number n of ethylene oxide must be 0.5 to 7. The use of the poly(oxyethylene) alkyl ether sulfate having $R_2$ of less than 9 carbon atoms results in the poor detergency.

Contrary to this, the use of the poly(oxyethylene) alkyl ether sulfate having $R_2$ of more than 15 carbon atoms decreases the foamability. When the average addition mol number n of ethylene oxide is less than 0.5, the liquid detergent composition is caused a turbidity with the lapse of time. Contrary to this, when the average addition mol number n of ethylene oxide is more than 7, the detergency is decreased.

Examples of the counter ion M'' is the general formula (II) are alkali metals such as sodium and potassium, alkaline earth metals such as magnesium, an ammonium residual group, and substituted ammonium residual groups such as monoethanolamine, diethanolamine, and triethanolamine. Of these counter ions, the unsubstituted and substituted ammonium residual groups are preferably used in the present invention.

These poly(oxyethylene) alkyl ether sulfate are preferably included at a concentration of 10% to 50% by weight, more preferably 20% to 30% by weight, in an aqueous medium.

According to the present invention, the above-mentioned components (a) and (b) must be included in a weight ratio of the component (a) to the component (b) (i.e., (a)/(b)) of 1/5 to $\frac{1}{2}$, preferably $\frac{1}{4}$ to $\frac{1}{3}$. When the ratio (a)/(b) is less than 1/5, the film formation preventing capability of the alpha-sulfonated fatty acid disalts cannot be sufficiently exhibited. Contrary to this, when the ratio (a)/(b) is more than $\frac{1}{2}$, the film formation preventing capability is unpreferably decreased.

The present liquid detergent composition can optionally contain, in addition to the above-mentioned essential constituents, any conventional ingredients, as long as the desired film formation preventing effect is not adversely affected. Examples of such optional conventional ingredients are surfactants conventionally used in detergent, such as anionic surfactants (e.g., sodium alkyl benzene sulfonates and sodium alkyl sulfate), nonionic surfactants (e.g., polyoxyethylene alkyl ether), and cationic surfactants (e.g., trimethyl fatty ammonium chloride), stabilizers (e.g., ethyl alcohol), perfumes, and dyes.

The present liquid detergent compositions can be produced in any conventional manner, for example, by mixing the above-mentioned components (a) and (b), and optional ingredients. The preferable solid concentration of the present liquid detergent composition is within the range of from 15% to 60% by weight, more preferably 25% to 40% by weight.

EXAMPLES

The present invention now will be further illustrated by, but is by no means limited to, the following Examples and Comparative Examples.

EXAMPLES AND COMPARATIVE EXAMPLES

The ingredients listed in Table 1 were mixed at room temperature to prepare liquid detergent compositions.

The film formation property of the liquid detergent compositions thus prepared were evaluated as follows:

A 15 g amount of the sample composition was placed in a 20 ml beaker and was allowed to stand for 24 hours in a constant temperature room having a temperature of 25° C. and a relative humidity of 65% RH. The liquid surface in the beaker was then observed and the film formation property was evaluated according to the following criteria:

A: No film formation was observed in the liquid surface.

B: Film formation was observed in a portion of the liquid surface.

C: Film formation was observed in the entire liquid surface.

The results are shown in Table 1.

TABLE 1

| | | (% by weight based on composition****) | | | | | | | | | | | |
|---|---|---|---|---|---|---|---|---|---|---|---|---|---|
| Run No. | | 1* | 2 | 3 | 4 | 5* | 6 | 7 | 8 | 9* | 10* | 11 | 12* |
| Disalt of alpha-sulfonated fatty acid | | | | | | | | | | | | | |
| $R_1$ | Counter ion | | | | | | | | | | | | |
| 6 | $NH_4$—$NH_4$ | 10 | — | — | — | — | — | — | — | — | — | — | — |
| 8 | $NH_4$—$NH_4$ | — | 10 | — | — | — | — | — | — | — | — | — | — |
| 12 | $NH_4$—$NH_4$ | — | — | 10 | — | — | — | — | — | — | — | — | — |
| 16 | $NH_4$—$NH_4$ | — | — | — | 10 | — | — | — | — | — | — | — | — |
| 18 | $NH_4$—$NH_4$ | — | — | — | — | 10 | — | — | — | — | — | — | — |
| 10 | $NH_4$—$NH_4$ | — | — | — | — | — | 10 | — | — | — | — | — | — |
| 10 | TEA**—TEA | — | — | — | — | — | — | 10 | — | — | — | 15 | — |
| 10 | $NH_4$—TEA | — | — | — | — | — | — | — | 10 | — | — | — | 30 |
| 10 | Na—Na | — | — | — | — | — | — | — | — | 10 | — | — | — |
| Salt of poly(oxyethylene) alkyl ether sulfuric acid | | | | | | | | | | | | | |
| $R_2$ | n | M'' | | | | | | | | | | | |
| 13 | 3 | TEA | 30 | — | — | — | — | — | — | — | 30 | 30 | 30 | 30 |
| 12.5 | 3 | Na | — | 30 | — | — | — | — | — | — | — | — | — | — |
| 12 | 3 | $NH_4$ | — | — | 30 | — | — | — | — | — | — | — | — | — |
| 14 | 3 | MEA*** | — | — | — | 30 | — | — | — | — | — | — | — | — |
| 11-15 | 3 | $NH_4$ | — | — | — | — | 30 | — | — | — | — | — | — | — |
| 12.5 | 0.5 | $NH_4$ | — | — | — | — | — | 30 | — | — | — | — | — | — |
| 12.5 | 7 | $NH_4$ | — | — | — | — | — | — | 30 | — | — | — | — | — |
| 12.5 | 3 | $NH_4$ | — | — | — | — | — | — | — | 30 | — | — | — | — |
| Film formation property | | | C | A | A | A | B | A | A | A | C | C | A | B |

*Comparative Example
**TEA = Triethanol amine
***MEA = Monoethanol amine
****the remainder of the composition is aqueous medium.

We claim:

1. An aqueous liquid detergent composition comprising:

(a) disalt of an alpha-sulfonated fatty acid having the general formula (I):

$$R_1-\underset{\underset{SO_3M'}{|}}{CH}-COOM \quad (I)$$

wherein $R_1$ is an alkyl or alkenyl group having 8 to 16 carbon atoms and M and M' are independently a cation capable of forming a water-soluble salt selected from the group consisting of substituted and unsubstituted ammonium groups; and (b) an poly(oxyethylene) alkyl ether sulfate having the general formula (II):

$$R_2-O-(CH_2CH_2O)_nSO_3M'' \quad (II)$$

wherein $R_2$ is an alkyl group having 9 to 15 carbon atoms, n is a number of 0.5 to 7, and M'' is a cation selected from the group consisting of alkali metals, alkaline earth metals, substituted and unsubstituted ammonium groups, and the weight ratio of the component (a) to the component (b) being within the range of from $\frac{1}{4}$ to $\frac{1}{2}$.

2. A liquid detergent composition as claimed in claim 1, wherein said disalt of alpha-sulfonated fatty acid is the 2 ammonium, 2 triethanolamine, or 2 diethanolamine salt of alpha-sulfonated lauric acid, alpha-sulfonated myristic acid, alpha-sulfonated palmitic acid, alpha-sulfonated hardened palm fatty acid, or alpha-sulfonated coconut fatty acid.

3. A liquid detergent composition as claimed in claim 1, wherein the disalt of alpha-sulfonated fatty acid is included at a concentration of 2% to 25% by weight in an aqueous medium.

4. A liquid detergent composition as claimed in claim 1, wherein the poly(oxyethylene) alkyl ether sulfate is included at a concentration of 10% to 50% by weight in an aqueous medium.

5. A liquid detergent composition as claimed in claim 1, wherein the solid concentration in the aqueous medium is within the range of from 15% to 60% by weight.

* * * * *